United States Patent [19]

Kensinger

[11] Patent Number: 4,639,952

[45] Date of Patent: Feb. 3, 1987

[54] CONVERTIBLE BEDDING ASSEMBLY AND MATTRESS

[76] Inventor: Roger C. Kensinger, 6211 W. Northwest Hwy., #2100, Dallas, Tex. 75225

[21] Appl. No.: 695,549

[22] Filed: Jan. 28, 1985

[51] Int. Cl.[4] ..... A47C 17/04; A47C 27/05; A47C 27/16

[52] U.S. Cl. ..... 5/13; 5/465; 5/481

[58] Field of Search ..... 5/13, 465, 12, 411, 5/481, 474; 297/DIG. 1

[56] References Cited

U.S. PATENT DOCUMENTS

| | | | |
|---|---|---|---|
| 658,789 | 10/1900 | Legg . | |
| 1,271,672 | 7/1918 | Crowley et al. | 5/465 |
| 1,841,410 | 1/1932 | Karr . | |
| 1,927,109 | 9/1933 | Abrams | 5/465 |
| 2,468,558 | 4/1949 | Johnson | 5/481 |
| 2,545,311 | 3/1951 | Rosberger | 5/465 |
| 2,576,455 | 11/1951 | Gratt . | |
| 3,087,171 | 4/1963 | Hoagland et al. | 5/478 |
| 3,242,507 | 3/1966 | Peterson . | |
| 3,310,300 | 3/1967 | Lawson | 5/481 |
| 3,879,598 | 4/1975 | Darling . | |
| 3,879,777 | 4/1975 | Walker . | |
| 3,892,001 | 7/1975 | Schneider . | |
| 4,004,305 | 1/1977 | Rubin | 5/13 |
| 4,040,133 | 8/1977 | Gilreath . | |
| 4,236,260 | 12/1980 | Mizelle | 5/13 |
| 4,316,298 | 2/1982 | Russo et al. | 5/465 |
| 4,442,556 | 4/1984 | Craigie | 5/13 |
| 4,447,921 | 5/1984 | Greenblatt . | |

FOREIGN PATENT DOCUMENTS

| | | | |
|---|---|---|---|
| 20529 | 12/1900 | United Kingdom | 5/465 |
| 1593433 | 7/1981 | United Kingdom | 5/481 |

OTHER PUBLICATIONS

"Foam-O-Lator", an ad on p. 47 of the May 1984 issue of *Bedding* Magazine.

*Primary Examiner*—Alexander Grosz
*Attorney, Agent, or Firm*—Warren B. Kice

[57] ABSTRACT

A convertible bedding assembly and mattress in which a foldable frame assembly is operatively attached to a sofa or chair portion for movement between an expanded position and a folded position. A first mattress is disposed on the frame assembly and a second mattress extends over the first mattress in at least said expanded position, with the width of the second mattress exceeding the width of the first mattress and being at least equal to the width of the frame assembly. The second mattress is a composite assembly including a pair of overlying flexible resilient pads and a wire layer sandwiched between the pads. A strip of rigid material extends along the edge portions of the wire layer, and the latter edge portions are wrapped around the strips and secured thereto.

2 Claims, 4 Drawing Figures

CONVERTIBLE BEDDING ASSEMBLY AND MATTRESS

BACKGROUND OF THE INVENTION

This invention relates to a convertible bedding assembly and more particularly, to such a bedding assembly in which a sofa or chair portion is adapted to expand into a bed.

Convertible beds are commonplace and utilize a mattress which rests on a collapsible frame assembly which is folded within a sofa during nonuse. However, because of the conventional dimension of these type of designs, the mattress must have a thickness dimension as well as a length and width dimension substantially less than that of a full size bed mattress. As a result, the mattress normally accompanying a sofa bed is relatively uncomfortable and does not cover the exposed collapsible frame assembly which can cause discomfort and possible injury to the user.

Also, these conventional sofa bed assemblies require special sheeting and covers due to the unconventional dimensions of the mattress discussed above, thus adding to its overall expense.

SUMMARY OF THE INVENTION

It is therefore an object of the present invention to provide a convertible bedding assembly which includes a dual mattress arrangement, the combined thickness of which is substantially identical to the thickness of a standard bed.

It is a further object of the present invention to provide an assembly of the above type in which the bed portion of the sofa bed is as comfortable as a standard bed.

It is still further a object of the present invention to provide a bedding assembly of the above type in which a supplemental mattress is utilized which extends over the regular mattress and which can be easily folded and stored during nonuse.

It is a further object of the present invention to provide a bedding assembly of the above type in which the supplemental mattress has a width and length portion which is compatable with standard sheeting and cover dimensions.

It is a still further object of the present invention to provide a bedding assembly of the above type in which the width and length dimensions of the supplemental mattress is as least as great as the width of the collapsible frame assembly so that it covers the frame assembly and protects the user therefrom.

It is a still further object of the present invention to provide a bedding assembly of the above type in which the length of the supplemental mattress is greater than the length of the collapsible frame assembly and the first mattress.

It is a still further object of the present invention to provide a mattress assembly of the above type which extends over the conventional mattress of a sofa bed and can be easily stored during nonuse.

Toward the fulfillment of these and other objects, the bedding assembly of the present invention comprises a collapsible frame assembly operatively attached to a sofa or chair portion for movement between an expanded position and a folded position. A supplemental mattress extends over the conventional mattress normally associated with the sofa bed to form a composite assembly which increases the overall mattress thickness to a conventional size. The width of the supplemental mattress exceeds the width of the first mattress and is at least equal to the width of the frame assembly to cover the frame assembly and protect the user therefrom.

BRIEF DESCRIPTION OF THE DRAWINGS

The above brief description, as well as further objects, features and advantages of the present invention will be more fully appreciated by reference to the following description of the presently preferred but nonetheless illustrative embodiments in accordance with the present invention, when taken in conjunction with the accompanying drawings wherein.

DESCRIPTION OF THE PREFERRED EMBODIMENT

Figure 1:
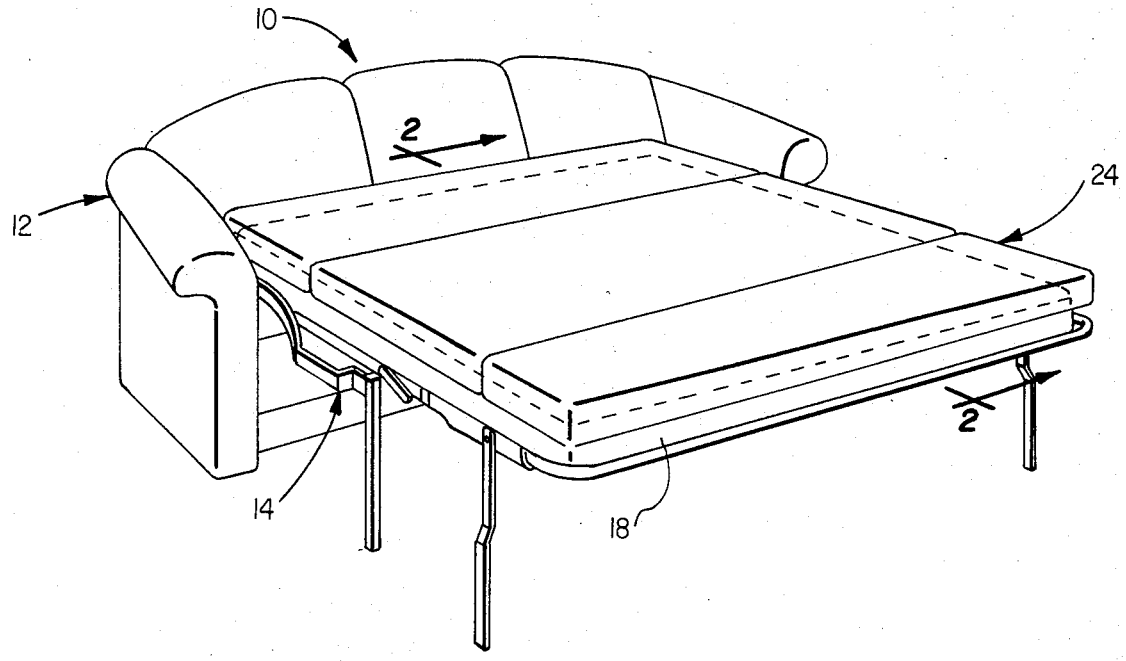
FIG. 1 is a perspective view showing the convertible bedding assembly of the present invention in an expanded position.

Referring to FIG. 1 of the drawings, the reference numeral 10 refers, in general, to a bedding assembly of the present invention, which is in the form of a sleep sofa having a sofa portion 12 and a collapsible frame assembly 14. The sofa portion 12 and the frame assembly 14 are of a conventional design and function to permit the frame assembly to fold between a collapsed position (not shown) in which the frame assembly extends within the base of the sofa portion, and the expanded position shown in which the frame assembly extends outwardly from the sofa position and supports a mattress 18.

Figure 2:
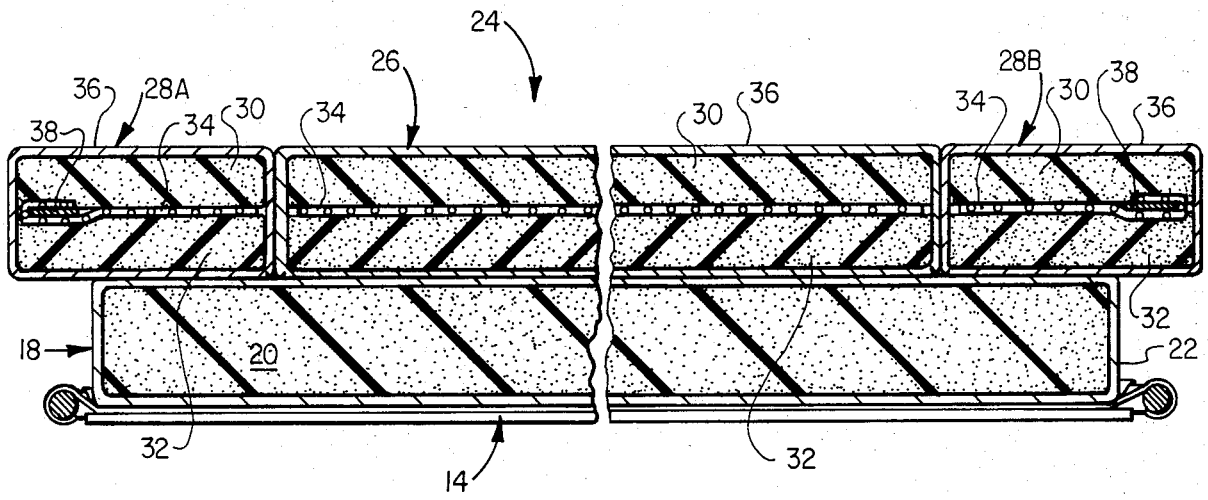
FIG. 2 is a cross sectional view taken along the line 2—2 of FIG. 1.

As better shown in FIG. 2 the mattress 18 consists of a flexible resilient padding 20, preferably of polyurethane foam, surrounded by a ticking, or cover 22. The mattress 18 has a width slightly less than the width of the frame assembly 14 in order to permit the mattress to be contained within the confines of the sofa portion 12 during nonuse. The thickness of the mattress 18 is relatively small, i.e. approximately one-half the thickness of a standard mattress, in order to enable it to fit within the sofa portion 12 during nonuse.

A supplemental mattress 24 extends over the mattress 18 and has a length and a width slightly greater than the length and the width, respectively, of the mattress 18. For example, if the width of the mattress 18 is 54 inches, then the width of the mattress 24 would be 60 inches, resulting in a 3 inch overhang on each side. In a similar manner the mattress 24 would overhang the mattress 18 a distance of 3 inches at each end. As a result the mattress 24 extends over the otherwise exposed outer marginal portion of the frame assembly 14.

The mattress 24 consists of these portions—a center portion 26 and two side portions 28A and 28B disposed to either side of the center portion and in an abutting relation thereto. Each mattress portion 26, 28A and 28B consists of upper and lower flexible resilient pads 30 and 32 respectively, a wire layer 34 sandwiched between the pads, and a ticking, or cover 36, extending around the outer surfaces of the assembly thus formed.

Figure 3:
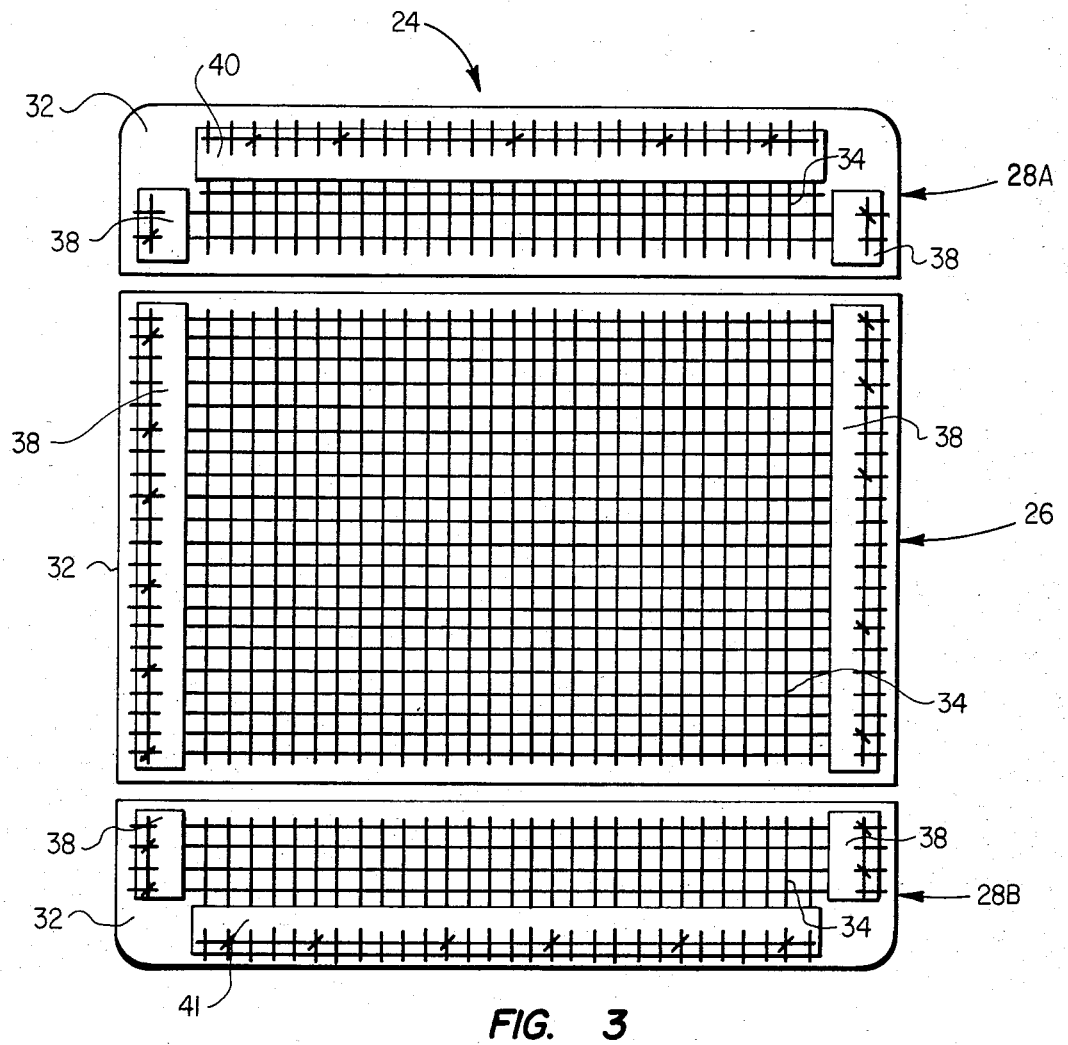
FIG. 3 is a cross sectional view taken along the line 3—3 of FIG. 2.

As viewed in FIG. 3, a strip 38 of rigid material, such as wood, is disposed along the side edge portions of the wire layer 34 of each of the mattress portions 26, 28A, and 28B and the latter edge portions are wrapped around the strips and fastened to the upper surfaces thereof. In a similar manner a strip 40 of rigid material, such as wood, is disposed along the end portions of the wire layer 34 associated with the mattress portions 28A and 28B, and the latter end portions are wrapped around the strips and fastened to the upper surfaces thereof.

Figure 4:
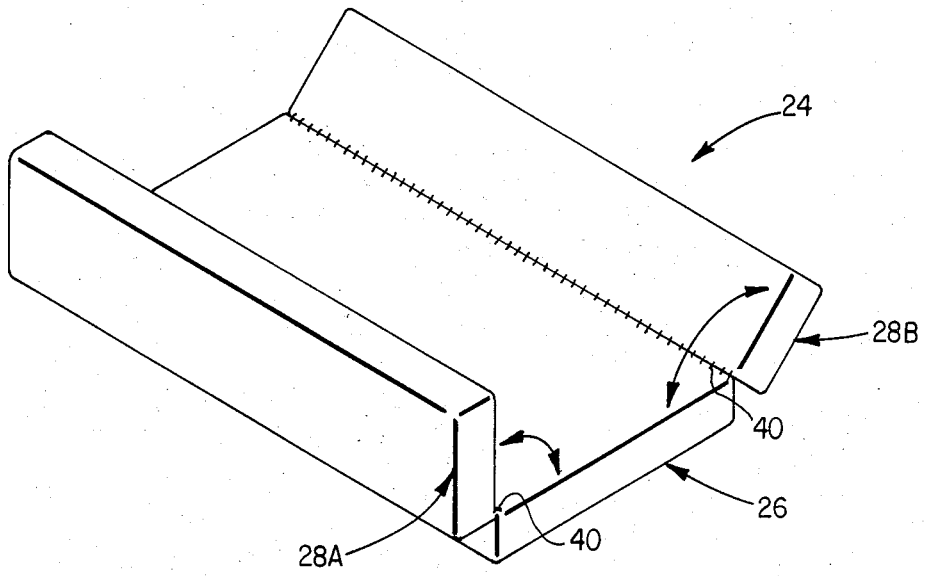
FIG. 4 is a perspective view of the assembly of FIGS. 1–3 shown in a partial folded condition.

As shown in FIG. 4 the mattress portions 28A and 28B are hinged to the portion 26 along their respective abutting edges by a string which is stitched through the portions as shown. This permits the portions 28A and 28B to be folded inwardly towards the center portion 26 to facilitate storage of the mattress 24, if necessary.

Several advantages result from the foregoing. For example, the combined thickness of the two mattresses 18 and 24 is double that of the mattress 18 which increases the comfort of the assembly and results in a standard thickness to accommodate standard sheets and covers. Also, the mattress 24 extends over the exposed portion of the frame assembly 14 and thus improves the appearance of the assembly when in use and reduces the chance of injury which otherwise would be possible by contact with the exposed metal portions of the frame assembly 14.

It is understood that several variations may be made in the foregoing without departing the scope of the present invention. For example, the particular types of materials used can be varied and the mattress portions 28A and 28B can be hinged to the center portion 26 in a manner different from that described above. Also, the present invention is not limited to a sleep sofa but also is applicable to chairs or the like.

A latitude of modification, change and substitution is intended in the foregoing disclosure and in some instances some features of the invention will be employed without a corresponding use of other features. Accordingly, it is appropriate that the appended claims be construed broadly and in the manner consistent with the spirit and scope of the invention therein.

What is claimed is:

1. A convertible bedding assembly comprising a sofa, a chair, or other furniture portion; a foldable frame assembly operatively attached to said portion for movement between an expanded position and a folded position; a first mattress disposed on said frame assembly; and a second mattress extending over said first mattress in at least said expanded position, said second mattress comprising a flexible, resilient pad, a wire layer overlying said pad, a strip of rigid material extending along, and secured to, the edge portions of said wire layer, and an additional flexible resilient pad overlying said wire layer and said rigid material to form a composite assembly; said second mattress being formed by a center piece and two side pieces extending to both sides of said center piece and connected to aid center piece in a manner to permit said side pieces to fold towards said center piece; the width of said second mattress exceeding the width of said first mattress and being at least equal to the width of said frame assembly; and length of said second mattress exceeding the length of said frame assembly and said first mattress.

2. The assembly of claim 1 wherein said edge portions of said wire layer are wrapped around said rigid material.

* * * * *